US006446305B1

(12) United States Patent
Kneeland

(10) Patent No.: US 6,446,305 B1
(45) Date of Patent: Sep. 10, 2002

(54) ROLLERLESS DOOR CHECK MECHANISM

(75) Inventor: David Allen Kneeland, Whitmore Lake, MI (US)

(73) Assignee: Dura Global Technologies, Rochester Hills, MI (US)

( * ) Notice: Subject to any disclaimer, the term of this patent is extended or adjusted under 35 U.S.C. 154(b) by 0 days.

(21) Appl. No.: 09/650,309

(22) Filed: Aug. 29, 2000

(51) Int. Cl.[7] ..... E05F 13/02

(52) U.S. Cl. ..... 16/82; 16/71; 16/72; 16/49; 16/50; 292/277

(58) Field of Search ..... 16/82, 86 A, 86 B, 16/86 C, 86 R, 85, 325, 332, 334, 337, 345; 292/266, 269, 273, 277; 70/93, 102, 136

(56) References Cited

U.S. PATENT DOCUMENTS 4,388,744 A * 6/1983 Pantke et al. ..... 16/273
4,472,857 A * 9/1984 Guionie et al. ..... 16/344
4,829,633 A 5/1989 Kassner
4,833,755 A * 5/1989 Bonin ..... 16/86 A
5,074,010 A * 12/1991 Gignac et al. ..... 16/334
5,152,030 A * 10/1992 Cogo ..... 16/86 C
5,173,999 A 12/1992 Carswell
5,237,723 A 8/1993 Little
5,452,501 A 9/1995 Kramer
5,474,344 A * 12/1995 Lee ..... 16/86 C
5,862,570 A 1/1999 Lezuch
6,176,040 B1 * 1/2001 Sugihara ..... 16/86 C
6,237,190 B1 * 5/2001 Grumm et al. ..... 16/82

* cited by examiner

*Primary Examiner*—Anthony Knight
*Assistant Examiner*—Doug Hutton
(74) *Attorney, Agent, or Firm*—Casimir R. Kiczek

(57) ABSTRACT

A check mechanism for a motor vehicle door includes a housing secured to either the vehicle frame or the door and a check arm secured to the other one of the vehicle frame and the door. The door check extends into the housing through an opening in the housing. A pair of opposed guides are located within the housing and engage opposite sides of the check arm. Each guide has a generally V-shaped portion, in cross-section, engaging the check arm to generally form a line contact between the guide and the check arm. Spring members such as elastomeric springs bias the guides toward each other and the check arm. The guides and the check arm are adapted to resist movement of the closure relative to the vehicle frame when the guide engages predetermined locations of the check arm. When the door is moved relative to the frame, the guides slide along the exterior surface of the check arm. Preferably, the check arm has a covering of plastic material and each guide has a contact portion comprising a low friction material such as polytetrafluoroethylene.

25 Claims, 3 Drawing Sheets

ROLLERLESS DOOR CHECK MECHANISM

FIELD OF THE INVENTION

The present invention generally relates to a door check and, more particularly, to a door check for holding a door of a motor vehicle in an open or partially open position.

BACKGROUND OF THE INVENTION

Door check mechanisms are typically provided in a motor vehicle, such as an automobile, to control movement of the vehicle doors in open positions by providing resistance against movement when the doors are predetermined open positions. The door check mechanism can be integral with a door hinge assembly or independent of the door hinge assembly. Door check mechanisms typically have a pair of rolling elements, such as rollers or ball bearings, engaging opposite sides of a check arm. Spring members are provided to bias the rolling elements into engagement with the check arm. The rolling elements are free to rotate and therefore have rolling contact with the check arm as there is relative movement between the check arm and the rolling elements when the door is opened and closed. The check arm is typically provided with detents to receive the rolling elements when the vehicle door is in a closed, fully open, and/or desired intermediate position. With the balls biased into the detents, the vehicle door is held in the position. To move the vehicle door out of the position, adequate force must be applied to the vehicle door to overcome the spring bias and move the rolling elements out of the detents.

While such door check mechanisms may adequately hold vehicle doors in position, they have significant problems. For example, the rolling elements of the check mechanisms need lubrication such as grease. Additionally, the check mechanisms often develop noises such as squeaks which are very loud, particularly if adequate lubrication is provided. Moreover, the check mechanism cannot be painted after assembly because of the lubricant. Accordingly, there is a need in the art for an improved door check mechanism which does not require lubricant, which has reduced noise, and/or can be painted as an assembly.

SUMMARY OF THE INVENTION

The present invention provides a door check mechanism for a motor vehicle which overcomes at least some of the above-noted problems of the related art. According to the present invention, a check mechanism for a frame and a closure movable relative to the frame comprises, in combination a housing securable to either the frame or the closure and a check arm securable to the other one of the frame and the closure. The check arm extends into an opening of the housing. At least one guide is within the housing and engages the check arm. At least one spring member biases the guide toward the check arm. The guide and the check arm are adapted to resist movement of the closure relative to the frame when the guide engages predetermined locations of the check arm and are adapted to provide sliding contact therebetween upon movement of the closure relative to the frame.

According to another aspect of the present invention, a check assembly comprises, in combination, a housing securable to either the frame or the closure and a check arm securable to the other one of the frame and the closure. The check arm extends into the housing though an opening in the housing. At least one guide is within the housing and engages the check arm. The guide is held against rotation relative to the housing during movement of the closure relative to the frame. At least one spring member biases the guide toward the check arm. The guide and the check arm are adapted to resist movement of the closure relative to the frame when the guide engages predetermined locations of the check arm.

According to yet another aspect of the present invention, a check assembly comprises, in combination, a housing securable to either the frame or the closure and a check arm securable to the other one of the frame and the closure. The check arm extends into the housing through an opening in the housing. A pair of opposed guides are located within the housing and engage opposite sides of the check arm. Each guide has a generally V-shaped portion, in cross-section, engaging the check arm to generally form a line contact between the guide and the check arm. Spring members bias the guides toward each other and the check arm. The guide and the check arm are adapted to resist movement of the closure relative to the frame when the guide engages predetermined locations of the check arm.

From the foregoing disclosure and the following more detailed description of various preferred embodiments it will be apparent to those skilled in the art that the present invention provides a significant advance in the technology and art of check mechanisms. Particularly significant in this regard is the potential the invention affords for providing a high quality, reliable, light weight, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
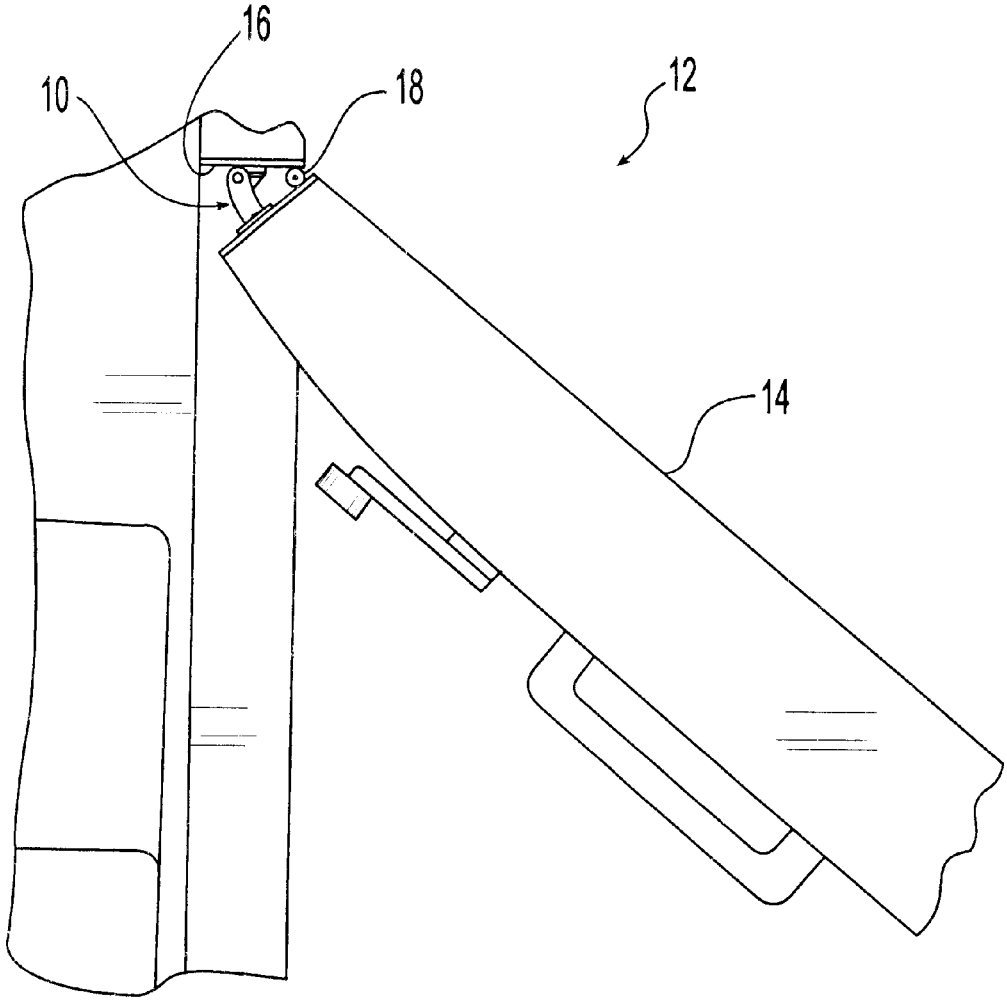
FIG. 1 is a top plan view of a door check mechanism according a preferred embodiment of the present invention installed in a motor vehicle.

It should be understood that the appended drawings are not necessarily to scale, presenting a somewhat simplified representation of various preferred features illustrative of the basic principles of the invention. The specific design features of the door check mechanism as disclosed herein, including, for example, specific dimensions, orientations, and shapes of the check arm and guides will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the door check mechanism illustrated in the drawings. In general, up or upward refers to an upward direction out of the plane of the paper in FIGS. 1 and 2 and down or downward refers to a downward direction into the plane of the paper in FIGS. 1 and 2. Also in general, fore or forward refers to a direction toward the front of the motor vehicle, that is, in a direction in the plane of the paper toward the top of the figure in FIG. 1 and aft or rearward refers to a direction toward the rear of the motor vehicle, that is, in a direction in the plane of the paper toward the bottom of the figure in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved check mechanism disclosed herein. The following detailed discussion of various alternative and preferred embodiments will illustrate the general principles of the invention with reference to a door check mechanism for use with a motor vehicle. Other embodiments suitable for other applications will be apparent to those skilled in the art given the benefit of this disclosure.

Referring now to the drawings, FIGS. 1 to 4 show a door check mechanism 10 for a motor vehicle 12, such as an automobile, according to a preferred embodiment of the present invention. While the illustrated embodiments of the present invention are particularly adapted for use with an automobile, it is noted that the present invention can be utilized with any motor vehicle having a steering-column mounted lever including trucks, buses, vans, recreational vehicles, earth moving equipment and the like, off road vehicles such as dune buggies and the like, air borne vehicles, and water borne vehicles.

FIG. 1 illustrates the motor vehicle 12 having a closure or door 14 supported by a pillar 16 of the motor vehicle frame with a hinge 18 so that the door 14 is pivotable about a vertical axis of the hinge between full open and full closed positions. The door check mechanism 10 is mounted between the pillar 16 and the door 14 as described in more detail hereinafter.

Figure 3A:
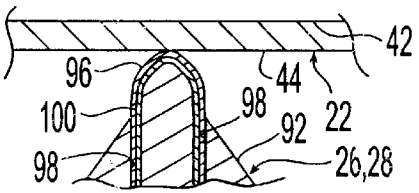
FIG. 3A is an enlarged, fragmented view of a portion of FIG. 3 showing the contact portion of one of the guides at the check arm.
Figure 2:
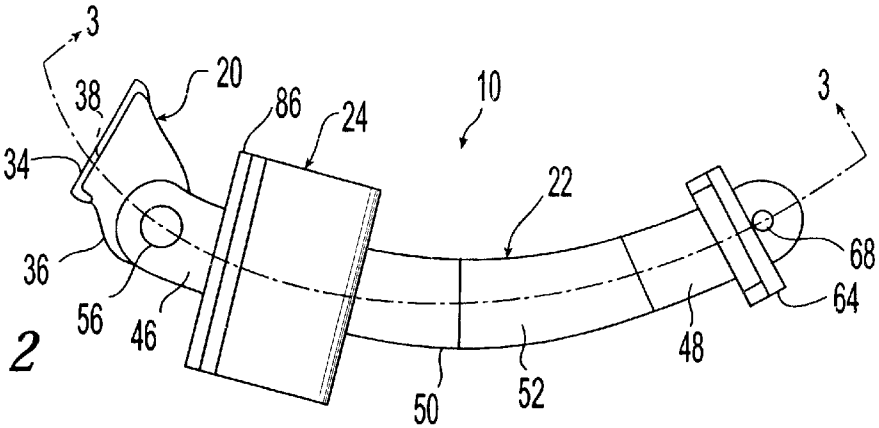
FIG. 2 is an enlarged top plan view of the door check mechanism of FIG. 1 removed from the motor vehicle.
Figure 3:
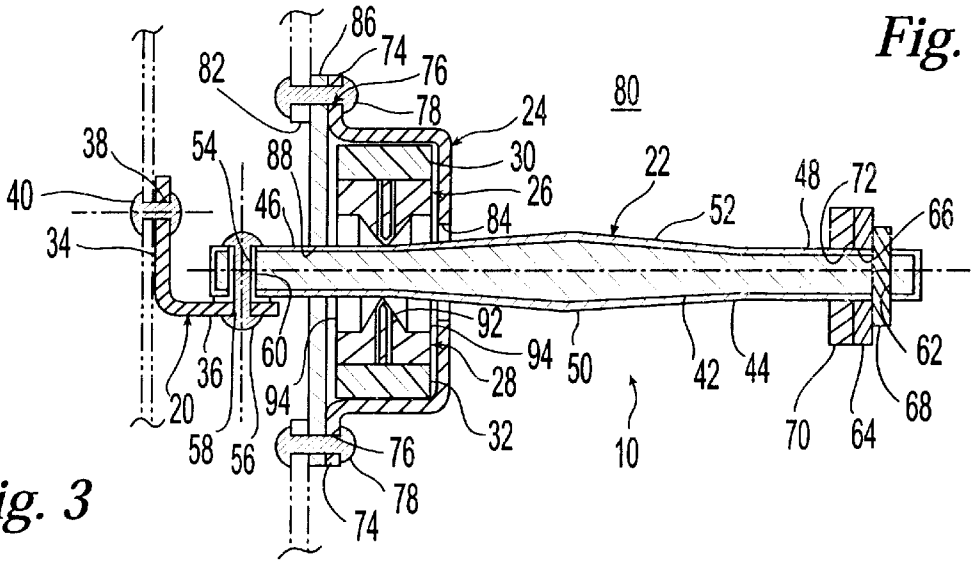
FIG. 3 is a cross-sectional view of the door check mechanism of FIGS. 1 and 2 taken along line 3—3 of FIG. 2.
Figure 4:
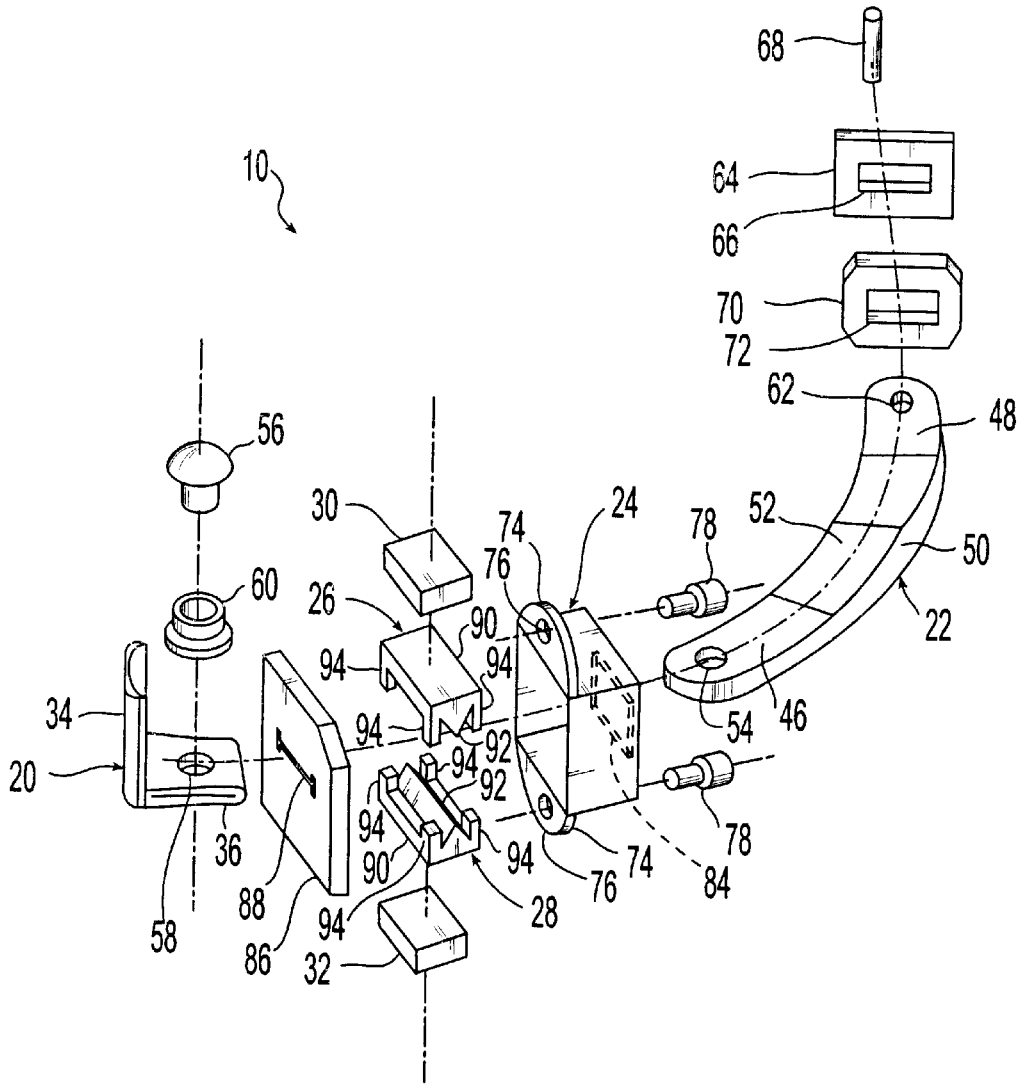
FIG. 4 is an exploded view of the door check mechanism of FIGS. 1 to 3.

As best shown in FIGS. 2 to 4, the illustrated door check mechanism 10 includes a mounting bracket 20 for securing the door check mechanism 10 to the pillar 16 of the motor vehicle frame, a check arm 22 pivotally attached to the mounting bracket 20, a housing 24 for securing the door check mechanism 10 to the door 14 of the motor vehicle 12, upper and lower guides 26, 28 within the housing 24 for cooperating with the check arm 22 to hold the door 14 in desired positions, and upper and lower spring members 30, 32 for biasing the guides 26, 28 toward and in contact with the check arm 22. It is noted that while the illustrated embodiment has the mounting bracket 20 secured to the pillar 16 and the housing 24 secured to the door 14, alternative embodiments having the mounting bracket 20 attached to the door 14 and the housing 24 secured to the pillar 16 are within the scope of the present invention. It is also noted that while the illustrated embodiment has the door check mechanism 10 separate from the hinge 18, alternative embodiments having the door check mechanism 10 integral with the hinge 18 are within the scope of the present invention.

The illustrated mounting bracket 20 has a generally perpendicular attachment portion 34 and a generally horizontal support portion 36 extending from the attachment portion 34. The mounting bracket 20 is preferably formed of steel but can be formed of any other suitable material. The attachment portion 34 is generally planar and is adapted to engage a vertical support surface such as the illustrated pillar 16 and is preferably provided with openings 38 to cooperate with mounting fasteners 40 to secure the mounting bracket 20 to the support surface. The illustrated mounting bracket 20 is secured with rivets but other suitable mounting fasteners 40 such as bolts or screws can be utilized. The support portion 36 of the mounting bracket 20 is generally planar and is adapted to pivotably support the check arm 22 as described in more detail hereinbelow.

The check arm 22 is generally shaped like a planar and elongate bar which is curved. The illustrated check arm 22 is curved in shape to coincide with the path of the door 14. The check arm 22 preferably has a main body formed of a material having a suitable strength such as, for example, steel and an outer coating or covering 44 encapsulating the main body 42 formed of a material having a suitable strength, suitable wear resistance, and suitable coefficient of friction such as, for example, MINLON available from the Dupont Corporation.

The illustrated check arm 22 has opposed upper and lower surfaces which are shaped substantially the same but are opposite facing. Each surface has generally flat or planar first and second end sections 46, 48 and a central portion 50 between the end sections 46, 48 and forming a camming surface 52. Each illustrated camming surface 52 is in the form of inclined ramps extending from each end portion 46, 48 to a peak located between the end portions 46, 48. The camming surfaces 52 are sized and shaped to cooperate with the upper and lower guides 26, 28 as described in more detail hereinafter.

A first or fixed end of the check arm 22 is preferably provided with an opening 54 for pivotally attaching the check arm 22 to the mounting bracket 20. The illustrated check arm 22 is attached to the mounting bracket 20 with a pivot rivet or axle 56 which vertically extends through the opening 54 of the check arm 22 and an opening 58 formed in the support portion 36 of the mounting bracket 20. Preferably, a bushing 60 is provided which is sized to encircle the pivot rivet 56 within the check arm opening 54. The illustrated bushing 60 has a flange which extends between the check arm 22 and the mounting bracket 20. The pivot rivet 56 and bushing 60 are sized such that the check arm 22 is pivotable about the vertical pivot axis formed by the pivot rivet 56. It is noted that many other suitable pivotable connections known to those skilled in the art can be utilized.

A second or free end of the check arm 22 is preferably provided with an opening 62 for attaching a stopper bracket or plate 64. The illustrated stopper plate 64 is a rectangular, planar plate having an rectangular-shaped opening 66 therein sized for receiving the check arm 22 therethrough. The stopper plate 64 is preferably formed of steel but can alternatively be formed of other suitable materials. The illustrated stopper plate 64 is retained on the check arm 22 by a pin 68 extending within the opening 62 in the check arm 22. A rubber stopper 70 is preferably provided on an inner side of the stopper plate 64 opposite the pin 68. The rubber stopper 70 is generally shaped like the stopper plate 64 and also has a rectangular-shaped opening 72 therein sized for receiving the check arm 22 therethrough. The rubber stopper 70 is retained on the check arm 22 by the stopper plate 64 and the pin 68. The rubber stopper 70, the stopper plate 64, and the pin 68 are sized, shaped and positioned to cooperate with the housing 24 to define the full open position of the door 14 as described in more detail hereinbelow.

The illustrated housing 24 is generally shaped like a rectangular box having an open side and a generally closed side. The housing 24 is preferably formed of steel but alternatively can be formed of other suitable materials. The housing 24 forms an interior space sized and shaped for closely receiving the guides 26, 28 and spring elements 30, 32 as described in more detail hereinafter. The open first or open side of the housing 24 is provided with upper and lower flanges 74 which are generally planar and adapted to engage a vertical support surface such as the illustrated edge of the door 14. The flanges 74 are preferably provided with openings 76 to cooperate with mounting fasteners 78 to secure the housing 24 to the support surface. The illustrated housing 24 is secured with rivets but other suitable mounting fasteners 78 such as bolts or screws can be utilized. The housing 24 is preferably mounted within a hollow interior space 80 of the door 14 at an opening 82 in the edge of the door. The second or closed side of the housing 24 is provided with an opening 84 sized and shaped for passage of the check arm 22 therethrough and into the hollow interior space 80 of the door 14.

With the housing 24 installed in this manner, the check arm 22 extends from the mounting bracket 20 through the opening 82 in the edge of the door 14, into the housing 24 through the open side, through the housing 24, and out of the housing 24 into the hollow interior space 80 of the door 14 through the opening 84 in the closed side of the housing 24. Preferably, a check arm seal 86 is provided to seal the opening 82 in the edge of the door 14 and the open side of the housing 24. The illustrated seal 86 is generally planar having a slit 88 formed therein for close passage of the check arm 22 therethrough. The seal 86 is preferably formed of a resilient sheet of flexible material such as a foamed polymer sheet with a plastic backing sheet. The illustrated seal 86 is secured in position by extending between the flanges 74 of the housing 24 and the edge of the door 14 and is clamped therebetween. Formed and assembled in this manner, the check arm seal 86 both closes the opening 82 in the edge door 14 to prevent contaminants such as dust from entering the housing 24 and/or the door 14 and wipes the upper and lower surfaces of the check arm 22 as the check arm 22 passes through the slit 88.

The illustrated upper and lower guides 26, 28 are identical except for orientation and location. Each guide 26, 28 has a rectangular shaped body portion 90 and an engagement or contact portion 92 extending from one side of the body portion 90. The contact portion 92 is sized and shaped to form a contact surface to engage the check arm 22, preferably a laterally extending line of contact. The illustrated contact portion 92 laterally extends across base portion 90 and is generally triangular-shaped in cross-section, with the base of the triangle contiguous with the body portion 90, to form a laterally extending line of contact when engaging the check arm 22. It is noted that the laterally extending line of contact appears as a point of contact in the longitudinal cross-sections of FIGS. 3 and 3A. The illustrated guide 26, 28 also has elongate legs 94 extending from each comer of the body portion 90 adjacent the contact portion 92. The legs 94 are laterally spaced apart a distance sized for passage of the check arm 22 therebetween and extend beyond the contact portion 92 such that the check arm 22 is laterally retained between the legs 94 when the contact portion 92 is engaging the check arm 22.

The contact surface formed by the contact portion 92 is preferably provided with a low friction material such as, for example, a fluorocarbon such as polytetrafluoroethylene (PFTE). A suitable polytetrafluoroethylene is TEFLON available from the Dupont Corporation. The illustrated embodiment utilizes a sheet 96 of TEFLON which is formed into a desired shape and inserted into openings or slots 98 in the contact portion 92 and insert molded thereto (as best shown in FIGS. 3 and 3A). The TEFLON sheet 96 preferably has a thickness in the range of about 0.00025 inches to about 0.0005 inches. The TEFLON sheet 96 preferably has a metal backing sheet or layer 100 to obtain and maintain the desired shape. The preferred shape of the TEFLON sheet 96 has a generally sharp edge with a radius of generally no more than a few thousandths of an inch which will form the laterally extending line of contact with the check arm 22, portions extending in each direction from the sharp edge along the inclined outer surface of the V-shaped contact portion 92 for a short distance, such as about three thousandths of an inch, in each direction, and and portions extending into the openings 98 to extend into the interior of the guide 26, 28. The remainder of the guide 26, 28 is preferably formed of a material having a suitable strength such as, for example, Nylon.

The upper and lower guides 26, 28 are located within the housing 24 above and below the check arm 22 with the contact portions 92 facing and engaging the upper and lower surfaces of the check arm 22. The upper and lower spring members 30, 32 act on the guides 26, 28 to resiliently bias the guides 26, 28 toward each other and the check arm 22 so that the contact portions 92 of the guides 26, 28 maintain contact with upper and lower surfaces of the check arm 22 as there is relative movement between the check arm 22 and the housing 24.

The illustrated upper and lower spring members 30, 32 are elastomeric type spring members. The spring members 30, 32 are generally rectangular shaped blocks of a resilient elastomeric material such as, for example, urethane. It is noted, however, that other types of suitable spring members 30, 32 can be utilized to resiliently bias the guides 26, 28 into engagement with the check arm 22.

FIGS. 2 and 3 illustrate the check mechanism 22 when the door 14 is in a closed or near full closed position. In this position, the guides 26, 28 are contacting the planar first end section 46 of the check arm 22. The check mechanism 10 resists further opening of the door 14 because of the inclined ramp or camming surface 52 of the central section 50 of the check arm 22. To pass over the ramp, the bias of the spring members 30, 32 must be overcome to move the guides 26, 28 outwardly as the thickness of the check arm 22 increases. This resistance preferably maintains the door 14 in the near closed position against unwanted opening such as, for example, the weight of the door 14 while the motor vehicle 12 is on an incline, wind, or the like. It is noted that the planar first end section 46 acts as detents to receive the guides, 26, 28. The check arm can additionally be provided with depressions or recesses to receive the guides 26, 28 when desired.

When the door 14 is opened, the operator applies a force to the door 14 which pivots the door 14 about the hinge 18. As the door 14 pivots, the housing 24 moves relative to the check arm 22 and passes over the check arm 22. This force must be large enough to overcome the bias of the spring members 30, 32 as the guides 26, 28 pass along the increasing thickness portion of the ramped central section 50. As the guides 26, 28 pass over the decreasing thickness portion of the central section 50, the spring members 30, 32 resiliently maintain contact between the guides 26, 28 and the upper and lower surfaces of the check arm 22. When the door 14 reaches a full or near full open position, the guides 26, 28 are contacting the planar second end section 48 of the check arm 22. The stopper 70 acts as a limit to define the full open position by engaging the outer surface of the housing closed side to prevent further movement of the housing 24 relative to the guide 26, 28 and thus further movement of the door 14 relative to the pillar 16.

With the door 14 in the open or near full open position, the check mechanism 10 resists closing of the door 14 because of the inclined ramp or camming surface 52 of the central section 50 of the check arm 22. To pass over the ramp, the bias of the spring members 30, 32 must be overcome to move the guides 26, 28 outwardly as the thickness of the check arm 22 increases. This resistance preferably maintains the door 14 in the near full open position against unwanted closing such as, for example, the weight of the door 14 while the motor vehicle 12 is on an incline, wind, or the like. It is noted that the illustrated check mechanism 10 is designed to hold the door in two positions, near full open and near full closed, but the check mechanism can be adapted to hold the door 14 in other positions such as, for example, midway between full open and full closed by adding detents and camming surfaces at suitable locations along the check arm.

When it is desired to close the door 14, the operator must apply a force to the door 14 which pivots the door 14 about the hinge 18 toward the closed position. As the door 14 pivots, the housing 24 moves relative to the check arm 22 and passes over the check arm 22. The force must be large enough to overcome the bias of the spring members 30, 32 as the guides 26, 28 pass along the increasing thickness portion of the ramped central section 50. As the guides 26, 28 pass over the decreasing thickness portion of the central section 50, the spring members 30, 32 maintain the guides 26, 28 in contact with the upper and lower surfaces of the check arm 22. When the door 14 reaches a full or near full closed position, the guides 26, 28 are contacting the planar first end section 46 of the check arm 22.

It is apparent from the above description that the improved check mechanism 10 according to the present invention does not require lubricant because the low friction material of the guides 26, 28 slides along the check arm 28. Preferably, this sliding contact is between a guide contact surface of a polytetrafluoroethylene such as TEFLON and check arm contact surface of a plastic such as MINLON. Additionally, the improved check mechanism 10 according to the present invention provides reduced noise during operation of the door 14 by eliminating rollers and rolling contact with the check arm. Furthermore, the improved check mechanism 10 according to the present invention can be painted as an assembly because lubricant is not present and paint does not adhere to the TEFLON surfaces.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the guides 26, 28 and the check arm 22 can each have many different configurations and materials. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A check mechanism for a frame and a closure movable relative to the frame, said check mechanism comprising, in combination:

a housing securable to one of the frame and the closure and having an opening;

a check arm securable to the other one of the frame and the closure and extending into the opening;

at least one guide within the housing and engaging the check arm;

at least one spring member biasing the at least one guide toward the check arm;

wherein the at least one guide and the check arm are adapted to resist movement of the closure relative to the frame when the at least one guide engages predetermined locations of the check arm and are adapted to provide sliding contact therebetween upon movement of the closure relative to the frame; and wherein the at least one guide has a generally V-shaped portion, in cross-section, engaging a camming surface forming the predetermined locations such that movement of the closure relative to the frame is resisted when the generally V-shaped portion engages the predetermined locations.

2. The check mechanism according to claim 1, wherein there is generally a line of contact between the at least one guide and the check arm.

3. The check mechanism according to claim 1, wherein the at least one guide is held against rotation relative to the housing during movement of the closure relative to the frame.

4. The check mechanism according to claim 1, wherein the at least one guide has a contact portion engaging the check arm and comprising a low friction material.

5. The check mechanism according to claim 4, wherein the low friction material is a polytetrafluoroethylene.

6. The check mechanism according to claim 5, wherein the contact portion comprises a ploytetrafluoroethylene sheet.

7. The check mechanism according to claim 6, wherein the at least one guide has a body portion comprising a plastic material and having openings at the contact portion and the polytetrafluoroethylene sheet extends into the openings.

8. The check mechanism according to claim 4, wherein the check arm has a covering of plastic material.

9. The check mechanism according to claim 1, wherein the at least one spring member biases the generally V-shaped portion toward the camming surface in a direction perpendicular to the camming surface.

10. The check mechanism according to claim 1, wherein the camming surface has first and second ramps meeting at a peak.

11. The check mechanism according to claim 6, wherein the polytetrafluoroethylene sheet has a metal backing layer.

12. A check mechanism for a frame and a closure movable relative to the frame, said check mechanism comprising, in combination:

a housing securable to one of the frame and the closure and having an opening;

a check arm securable to the other one of the frame and the closure and extending into the opening;

at least one guide within the housing and engaging the check arm;

at least one spring member biasing the at least one guide toward the check arm;

wherein the at least one guide and the check arm are adapted to resist movement of the closure relative to the frame when the at least one guide engages predetermined locations of the check arm; and wherein the at least one guide has a generally V-shaped portion, in cross-section, engaging a camming surface of the check arm and the at least one spring member biases the generally V-shaped portion toward the camming surface in a direction perpendicular to the camming surface.

13. The check mechanism according to claim 12, wherein the at least one guide and the check arm are adapted to provide sliding contact therebetween upon movement of the closure relative to the frame.

14. The check mechanism according to claim 12, wherein there is generally a line of contact between the at least one guide and the check arm.

15. The check mechanism according to claim 12, wherein the at least one guide has a contact portion engaging the check arm and comprising a low friction material.

16. The check mechanism according to claim 15, wherein the low friction material is a polytetrafluoroethylene.

17. The check mechanism according to claim 16, wherein the contact portion comprises a polytetrafluoroethylene sheet.

18. The door check according to claim 17, wherein the at least one guide has a body portion comprising a plastic material and having openings at the contact portion and the polytetrafluoroethylene sheet extends into the openings.

19. The check mechanism according to claim 12, wherein the check arm has a covering of plastic material.

20. The check mechanism according to claim 17, wherein the polytetrafluoroethylene sheet has a metal backing layer.

21. The check mechanism according to claim 12, wherein the camming surface forms the predetermined locations such that movement of the closure relative to the frame is resisted when the generally V-shaped portion engages the predetermined locations.

22. The check mechanism according to claim 21, wherein the camming surface has first and second ramps meeting at a peak.

23. A check mechanism for a frame and a closure movable relative to the frame, said check mechanism comprising, in combination:

a housing securable to one of the frame and the closure and having an opening;

a check arm securable to the other one of the frame and the closure and extending into the opening;

a pair of opposed guides within the housing and engaging opposite sides of the check arm, each of the guides has a generally V-shaped portion, in cross-section, engaging the check arm to generally form a line of contact between the guides and the check arm;

spring members biasing the guides toward each other and the check arm;

wherein the guides and the check arm are adapted to resist movement of the closure relative to the frame when the guides engage predetermined locations of the check arm;

wherein the V-shaped portion of the guides engage opposed camming surfaces forming the predetermined locations such that movement of the closure relative to the frame is resisted when the generally V-shaped portion of the guides engages the predetermined locations; and wherein the spring members bias the generally V-shaped portion of the guides toward the camming surface in a direction perpendicular to the camming surface.

24. The check mechanism according to claim 23, wherein the check arm has a covering of plastic material and each of the guides has a contact portion engaging the check arm and comprising a polytetrafluoroethylene.

25. The check mechanism according to claim 23, wherein the opposed camming surfaces each have first and second ramps meeting at a peak.

* * * * *